United States Patent [19]

Kerekes

[11] Patent Number: 4,560,906

[45] Date of Patent: Dec. 24, 1985

[54] LIGHTING SYSTEM AND COMPACT ELECTRIC LIGHTING UNIT

[75] Inventor: Béla Kerekes, Budapest, Hungary

[73] Assignee: Egyesult Izzolampa es Villamossagi RT., Budapest, Hungary

[21] Appl. No.: 623,626

[22] Filed: Jun. 25, 1984

Related U.S. Application Data

[63] Continuation-in-part of Ser. No. 337,693, Jan. 7, 1982, abandoned.

[30] Foreign Application Priority Data

Feb. 6, 1981 [HU] Hungary ..... 288/81

[51] Int. Cl.[4] ..... H01J 7/44; H01K 1/64

[52] U.S. Cl. ..... 315/47; 315/46; 315/53; 315/90; 315/91; 315/92; 315/313

[58] Field of Search ..... 315/32, 46, 47, 53, 315/73, 74, 88, 90, 91, 92, 93, 313, 315

[56] References Cited

U.S. PATENT DOCUMENTS

| | | | |
|---|---|---|---|
| 4,151,445 | 4/1979 | Davenport et al. | 315/92 |
| 4,232,252 | 11/1980 | Peil | 315/91 |
| 4,278,916 | 7/1981 | Regan et al. | 315/91 |
| 4,438,369 | 3/1984 | Hicks et al. | 315/90 X |

*Primary Examiner*—Palmer C. DeMeo
*Assistant Examiner*—Vincent DeLuca
*Attorney, Agent, or Firm*—Handal & Morofsky

[57] ABSTRACT

A lighting system having a high pressure gas discharge light source and an incandescent light source within a common sealed and evacuated bulb. A ballast unit fitted externally to the neck of the bulb includes in series with the incandescent light source an interrupter element and control circuitry therefor, and a choke coil in series with the gas discharge light source.

The control circuitry represents an equivalence logic with two variables, wherein the output terminal of an equivalence circuit is connected to the control input of the interrupter element while its input terminal is connected to a voltage divider system connected across the gas discharge light source. The output terminal is energized only if either both or neither of the input terminals of the equivalence circuit are energized. The interrupter element is closed when the output terminal of the equivalence circuit is energized.

The lighting system instantly emits light when switched on from the mains and maintains the illumination at an approximately constant level during the cool or cooling down periods of the gas discharge light source following its start, warm up, or re-start after switch off.

15 Claims, 5 Drawing Figures

LIGHTING SYSTEM AND COMPACT ELECTRIC LIGHTING UNIT

This is a CIP application of my copending application Ser. No. 337,693 filed Jan. 7, 1982 now abandoned.

FIELD AND BACKGROUND OF THE INVENTION

This invention relates to a lighting system comprising at least one high-pressure gas discharge lamp and at least one incandescent body or filament, and an impedance limiting the current of the gas discharge lamp wherein the gas discharge lamp and the current limiting impedance are connected in series and having the incandescent body or filament connected with them in parallel in the form of a standby filament or an incandescent lamp, wherein under the term "standby filament" one should understand an incandescent coil, arranged in a common evacuated or gas filled interior of a light-transmitting outer glass envelope, and wherein the system includes a controllable current-interrupter element connected in series with the incandescent body, and a control circuitry for the interrupter element, furthermore, the system includes a sensing element for sensing the state of the gas discharge lamp.

Efforts made nowadays to save energy have brought into the forefront the replacement of incandescent lamps of relatively poor efficiency by light sources with better luminous efficiency, particularly by low-pressure and high-pressure gas discharge lamps. However, the substitution of gas discharge lamps raises many problems. The geometrical dimensions of the low-pressure gas discharge lamps are large, while high-pressure gas discharge lamps cannot instantaneously emit light upon being switched on or upon being re-started immediately after being switched off while still warm.

It is known that steady efforts are being made to develop new light sources which combine the favorable properties of various light sources such as incandescent and high-pressure gas discharge lamps.

There have been many propositions for the operating of an incandescent lamp or "standby filament" parallel with a gas discharge lamp during the time interval when the gas discharge lamp still does not emit light, or its emitted light still does not have enough strength. FIG. 5 which will be discussed hereinafter, illustrates the time-voltage relationship within a gas discharge lamp. The initial stage of the diagram relates to the turning-on of the discharge lamp for its cold state, and later, it illustrates the voltage-time relationship during a turning-off, or repeated turning-on of the lamp in its warm state. Those time intervals are indicated where it is necessary to operate the incandescent body, because the discharge lamp still does not give off sufficient light. A large number of solutions became known to solve the problem and, wherein in addition to the gas discharge lamp, a single incandescent element is operated , which both in the turning-on in the warm state or, at the initial stage, will supplement the light of the discharge lamp. Such solutions are illustrated by the subject matter of U.S. Pat. Nos. 4,232,252 and 4,151,445. In such prior art literature, the sensing means which senses when it becomes necessary to operate the incandescent body, comprises a transformer. A transformer, as a sensing means, has a disadvantage in that it has large dimensions and it is expensive and, due to its dimensions, it cannot be placed within the lamp socket or into the neck portion, when it comes to the so-called "energy saver" lamps. Consequently, such solutions cannot be used in connection with energy saver lamps. U.S. Pat. No. 4,278,916 describes a relatively more complicated solution, according to which a separate incandescent element is used for the turning-on from the cold state and for the turning on from the warm state. In the latter solution the sensing means is represented by a resistor 28 serially connected with the discharge lamp and, as such, it will use the lamp current to a considerable extent, which will reduce the efficiency thereof, therefore, such solution again cannot be considered in connection with energy saving lamps.

SUMMARY OF THE INVENTION

It is an object of the lighting system according to the present invention to provide for the most advantageous sensing of the state of the discharge lamp and, accordingly, to provide a control means for the turning-on and off of the incandescent element of the system in such a manner, that the sensing means and the control circuit therefor should be relatively simple in its form, compact in its size, that is, it should be capable of being placed into the lamp neck portion or on the lamp neck and, at the same time the sensing means should not consume an appreciable amount of energy, that is, the lighting system should operate at a good efficiency rating.

The objectives of the invention are achieved by a lighting system and an electric lighting unit of compact design, wherein according to the invention there is provided a current interrupter (circuit breaker) and control circuitry therefor, which circuitry can be expressed as a two-variable equivalence function. The output of this control circuitry is connected to the input of the control means of the interrupter element, which is connected in series with the incandescent light source. The inputs of this control circuitry are connected to the respective branches of a voltage divider system which is connected between the terminals of the gas discharge light source and has the same number of dividing branches as the number of inputs of the control circuitry. The voltage dividing system consumes a negligeable amout of energy. This control circuitry is hereinafter referred to as the "equivalence circuit" in view of the fact that it causes the interrupter switch to open when the input levels of the equivalence circuit are equivalent the controllable interrupter element may be an electromagnetic switch, thyristor or triac (a bidirectional triode thyristor) connected in anti-parallel depending on the particular design requirements. It will be noted that the term "incandescent light source" is meant to include either an incandescent coil or a discrete traditional incandescent lamp, and the term "gas discharge light source" is meant to include either the discharge vessel of a gas discharge lamp or a traditional high-pressure gas dishcarge lamp. These light-emitting structural units may be built into separate bulbs or they may comprise the elements of a combined lamp or light unit of compact design, arranged in a common evacuated or gas-filled interior of a single glass envelope.

The function of the voltage divider in the control circuit of the lighting system according to the present invention is to produce the necessary logical values at the inputs of the equivalence circuit. At least one of the branches of the voltages divider system expediently contains at least one voltage-dependent element, e.g., a voltage-dependent resistor (i.e., a varistor) or a glow lamp, the advantage of this being that when the gas discharge light source is in its operational state, this branch comprising the voltage-dependent element is practically switched off and therefore does not consume power.

The equivalence circuit is a logical circuit the logical function of which is to provide "1" level at the output if the inputs are fed by signals of the same level, and a logical "0" level, if the inputs are fed by signals of different levels. The equivalence circuit comprises first and second AND-gates, an OR-gate ad two inverters connected between inputs of said first and second AND-gates, outputs of the first and second AND gates connected to inputs of the OR-gate and input terminals of the control means are represented by inputs of the first AND-gate, while output terminal of the control means is represented by output of the OR-gate.

In the preferred embodiment of the lighting system according to the present invention at least one of the inputs of the equivalent circuit hereinafter described has an analogue construction insofar as this is necessary to achieve the complex objectives of the invention. Namely, in this way it can be achieved that (particularly if a "pre-tension" is applied to the input so that an analogue connection should not occur between the input and output below a pre-determined level of the input signal, and furthermore if an elongate element is also used as the interrupter element, e.g., a triac) the linear divider branch can only commence changing, i.e. reducing, the light intensity via the "operative" branch of the equivalence circuit above a predetermined level of operating voltage of the gas discharge light source. This is necessary because the rate of increase of the light intensity is not linear from the start of operation. In the lighting system according to the present invention, any characteristic rate of change of the light intensity can be prescribed, but the customary one is that the combined light emission of the two kinds of light generation means should be approximately constant. In the preferred embodiment of the lighting system according to the present invention, it proved expedient to connect the gas discharge and incandescent light sources to the mains in parallel without any common point or junction; thus, e.g., one terminal of the mains is advantageously connected to the junction of the incandescent light source and the ballast impendance while the junction of the gas discharge light source and the interrupter element is connected to the other terminal of the mains. Namely, if a triac or similar active switching element is employed as the interrupter element, the arrangement and method of switching described above have considerable advantages from the point of view of control system design.

The electric lighting units of compact construction according to the present invention have been developed on the basis of the above-described principle of switching; they all comprise a gas discharge light source and an incandescent light source, respectively, electrically and mechanically connected to current lead-in supports and arranged in the evacuated or gas-filled interior of an outer glass envelope which is hermetically sealed from the ambient atmosphere, an impedance unit or ballast arranged outside the glass envelope and comprising a controllable interrupter element series-connected to the incandescent light source, and control circuitry for regulating the interrupter element, the arrangement being such that the gas discharge light source and the incandescent light source are insulated from one another and are electrically connected to a point outside the glass envelope, without a single common junction within the envelope, by means of the current lead-in supports.

This particular design comprising a mutually insulated and electrically independent wiring arrangement of the lighting system according to the present invention made it possible to develop further electric lighting units, also within the scope of the present invention, wherein the impedance unit arranged outside the evacuated or gas-filled interior of the glass envelope (containing the gas discharge and incandescent light sources) comprises a current-limiting impedance unit connected in series with one of the current lead-in supports of the gas discharge light source; a controllable interrupter element is connected in series with one of the current lead-in supports of the incandescent light source; and a voltage divider system is interposed between the current lead-in supports of the gas discharge light source, this voltage divider system being connected to the interrupter element via an equivalence circuit with at least two inputs. Expedient and favorable embodiments of electric lighting units of compact design according to the present invention comprising the discharge vessel of a high-pressure sodium vapor lamp, metal-halogen lamp or mercury vapor lamp have constructions wherein the main terminals of the ballast unit are connected to a lamp cap freely interchangeably fittable into a standard lamp-holder and/or wherein (according to Hungarian patent application No. 287/81 and corresponding U.S. patent application Ser. No. 340,297 filed Jan. 18, 1982) the ballast or impedance unit is developed in the form of an internally apertured, rotationally symmetrical body at least partly surrounding the neck of the external glass envelope and having a mantle surface enabling it to be fitted to the envelope neck over at least a predetermined portion of the neck, and/or wherein the neck of the glass envelope is rigidly fixed to the ballast or impedance unit and to the lamp cap such that it may only be detached by destruction.

When the system or unit is switched on, the incandescent light source immediately emits full light and simultaneously the gas discharge light source is also ignited. Since, however, the latter does not at this stage emit any light, the incandescent light source remains in operation until the gas discharge light source warms up. During this warming-up period it may be arranged that the light of the incandescent light source should gradually be reduced as the light emission from the gas discharge light source gradually increases. It may then be achieved that the combined illumination of the two light sources should remain approximately constant. Should there occur a momentary power cut or a rapid re-start, the incandescent light source will again emit its full light output and keep on operating until approximately 30–50 seconds have elapsed, at which time its function of providing light is taken over by the considerably more economic gas discharge light source. During this changeover of roles the level of illumination composed of the sum of the light emitted by the two light sources remains practically constant.

BRIEF DESCRIPTION OF THE DRAWINGS

The invention is further described purely by way of example by reference to a preferred embodiment illustrated in the accompanying drawings, wherein.

Description of the Preferred Embodiment

Figure 1:
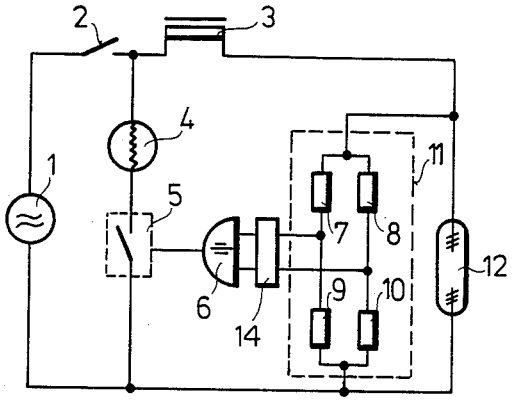
FIG. 1 is a circuit diagram for a lighting system according to the present invention.

According to the circuit diagram shown in FIG. 1, for a lighting system according to the invention the gas discharge light source 12 is connected to the A.C. mains 1 via a current-limiting impedance 3 and a switch 2. The incandescent light source or standby filament 4 is connected via a controllable interrupter element 5 of the switch 2 to the A.C. mains 1. The interrupter element 5 in the embodiment shown in FIG. 1 is controlled by an equivalence circuit 6, with a threshold value transducer 14 and with two inputs, each of which is connected to a respective dividing branch of a voltage divider system 11 connected across the terminals of a gas discharge vessel 12. One of the dividing branches comprises resistors 7 and 9 while the other branch contains resistors 8 and 10; the resistors 8, 10 are linear while the resistor 7 is a voltage-dependent resistor (i.e., a varistor), i.e. has voltage-dependent characteristics.

The lighting system according to the invention operates in the following way:

The logical state of the variable output of the equivalence circuit 6 wherein the interrupter element 5 is closed is designated by I. The symbol 0 designates the logical state (or signal level) when the interrupter element 5 is open, i.e. when the incandescent body is open-circuited (current-free). The logical states that may appear at the inputs of the equivalence circuit 6 are also designated by I and O. The linear dividing branch of the voltage divider system 11 comprising the resistors 8, 10 is dimensioned such that it supplies a voltage to the corresponding input of the equivalence circuit 6 which gives a 0 signal whenever that voltage is slightly below the threshold value of the operating voltage of the gas discharge light source 12, while the logic value of this voltage is I when the voltage is above the threshold value. The setting of the dividing branch which comprises the voltage-dependent resistor (i.e., varistor) 7 is such that it supplies a voltage of 0 logic level to the corresponding input of the equivalence circuit 6 when the voltage is somewhat below the threshold voltage of the mains voltage while above that value the logic level of the signal will be I. (It should be borne in mind that if the gas discharge light source 12 is not operational, the mains voltage appears on its terminals).

Figure 5:
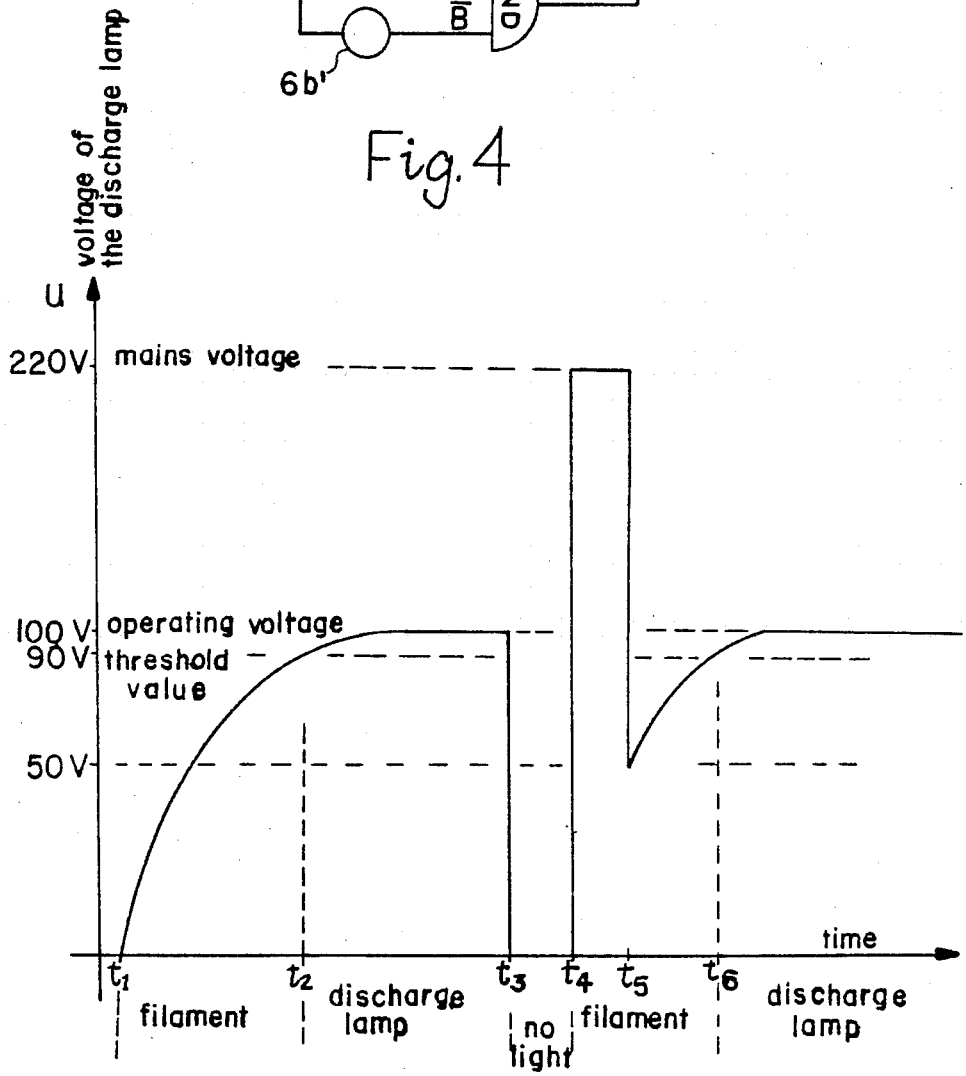
FIG. 5 illustrates in detail the voltage forms present in the circuit.

More particularly, it is known that after switching in, the cold high-pressure gas-discharge lamp cannot generate light and the terminals thereof has a voltage lower than the working voltage (interval $t_1$ to $t_2$) in FIG. 5. During heating up the voltage of the gas-discharge lamp successively approaches the working voltage value and the lamp begins to emit light in moment $t_2$ (the corresponding voltage value is e.g. approximately 90% of the working voltage). If it is a short break in the supply of the gas-discharge lamp (lasting from several seconds to at most 2 minutes (instant $t_3$) after switching-in the supply current (instant $t_4$) the gas-discharge lamp cannot generate light immediately. On its terminals it has at the beginning (up to instant $t_5$) the network voltage, the temperature of the lamp decreases, then a rapid flash from ignition may follow but the voltage drops under the value characteristic for the work, and then successively approaches the working voltage unless its threshold value is reached (instant $t_6$). This is the case of start in warm conditions. The voltage values given are only exemplary.

On the basis of the discription given above, it may readily be understood that the logical levels ("true states") of the two inputs of the equivalence circuit 6, 14 are identical. If the operating voltage of the gas discharge light source 12 has not yet reached the stabilized operational voltage, then the logical level of both inputs is 0. If the light of the gas discharge light source is extinguished, the signal level on each of the inputs is I. As the result of the known logical function of the equivalence circuit 6, the interrupter element 5 closes in both cases and therefore current flows through the incandescent light source 4 so that it is lit. If the gas discharge light source 12 emits light at the stabilized operational voltage, the logic levels of the signals are different from one another; in this embodiment the signal level of the input connected to the linear branch is I and the signal level of the voltage-dependent branch is O, hence no current can flow through the incandescent light source 4 because the interrupter element 5 is in its "open" state.

Figure 2:
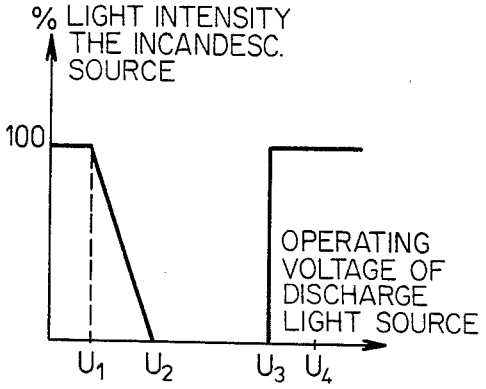
FIG. 2 is a graph showing the light intensity of the incandescent light source as a function of the operating voltage of the gas discharge light source.

FIG. 2 is a typical graphical representation of the control characteristics, plotting the light intensity of the incandescent light source 4 as a function of the operational voltage of the gas discharge light source 12. The significance of the specified voltage values shown in the graph are explained below.

$U_4$ is the mains voltage, in this example, 220 V. If, e.g., the discharge vessel of a high-pressure sodium vapor lamp 12 is connected to this mains, its voltage immediately upon switching on is 30 V. This voltage increases during the warmup period following the switch-on, but the discharge lamp emits an appreciable amount of light only when the voltage reaches the value of 50 V. It is, therefore, expendient to reduce the light intensity of the incandescent light source 4 from this moment on. This significant threshold of the operating voltage is designated by $U_1$. From this point onwards the light intensity of the gas discharge light source 12 increases rapidly until a stable value $U_2$ of the operating voltage is reached of approximately 100 V. At this point the current flowing through the incandescent light source 4 must be stopped. The operating voltage of modern high-pressure sodium vapor lamps operated from an A.C. mains of 200 V does not exceed 160 V. Accordingly, if the threshold voltage $U_3$ for changing the logic signal level from O to I for that input of the equivalence circuit which is connected to the divider branch comprising the voltage-dependent resistor 7 is set higher than 160 V, it is then ensured that the current may repeatedly only flow through the incandescent light source when the gas discharge light source 12 either has not started yet or has already stopped operating.

Figure 3:
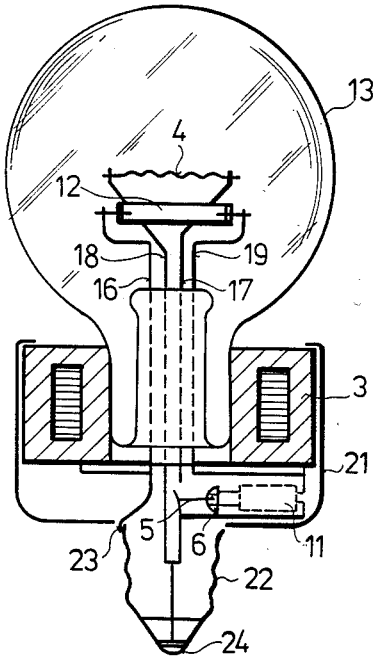
FIG. 3 is a diagrammatic sectional view of an electric lighting unit of compact construction according to the present invention, incorporating in one integrated unit the lighting system and the circuitry shown in FIG. 1.

FIG. 3 diagrammatically illustrates a section of a compact lighting unit according to the invention. This lighting unit represents a practical embodiment of the light system described above, and of its mode of operation, in the form of a single very small-sized unit which can be directly substituted for the traditional general lighting service incandescent lamp, i.e. without additional means or measures. A gas discharge light source 12 of a high pressure sodium vapor lamp and an incandescent light source 4 are arranged in a common glass bulb 13 and are held in place by current lead-in supports 16, 19 and 17, 18, respectively. These supports pass out of the glass bulb 13 via a hermetic metal-to-glass seal. The glass bulb 13 is a traditional incandescent lamp bulb and the dimensions, shape and structural features of the lamp correspond to those of the usual incandescent lamp.

The essence of the invention is the way of obtaining the control signal necessary for operating the filament. This means, it should be detected when the voltage value is at levels necessary for operating the filament.

Figure 4:
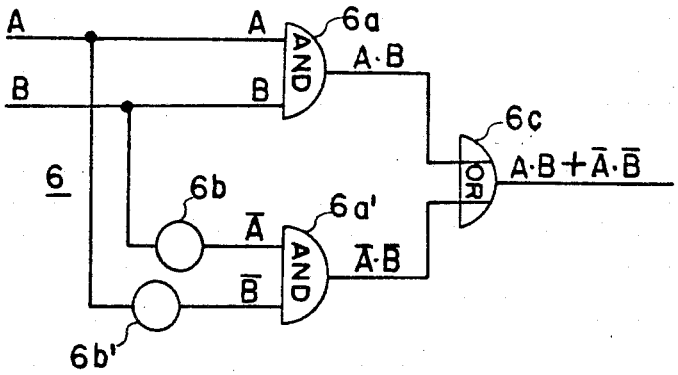
FIG. 4 illustrates the details of the equivalent circuit.

In the circuit arrangment according to FIGS. 1 and 4, there are two parallel electric members forming potential dividers (consisting of two electric resistors 7, 9 and 8, 10 each). The potential dividers generate input signals "A" and "B" (see FIG. 4) which arrive through the threshold value transducer 14 at the inputs for the equivalent circuit 6. More particularly and, as can be seen in FIG. 4, input signals A and B arrive at both the AND gate 6*a* and through the two inverters 6*b*,6*b'* at the other AND gate 6*a'*. the outputs of the AND gates 6*a*,6*a'* form the inputs of the OR gate 6*c* and, the output of the latter is the output of the equivalence circuit 6. It follows that if both inputs A and B coincide, then the output of the equivalence circuit is a logical 1 and, in such case, the interrupter 5 will turn on the incandescent filament 4. It follows that the equivalence circuit should be supplied with analog inputs and not digital because of its connection to the potential dividers.

A convenient pair of potential dividers ensure that the level of both input signals "A" and "B" correspond to logical "0" or "1" if the filament of lamp 4 should be operated. The logical level "0" of both input signals means that the voltage is below the working voltage of the gas-discharge lamp and the logical level "1" on the contrary, proves that it is at the higher voltage.

In these circumstances, it is possible to ensure the different logical levels of the input signals "A" and "B" if the filament shouldn't be operated.

The transversely mounted gas discharge light source 12 is essentially identical in construction with an embodiment of the invention described in Hungarian patent application No. 75/81, corresponding to U.S. Patent Application Ser. No. 337,692 filed Jan. 7, 1982. a rotationally symmetrically shaped toroidal self-inductive choke coil 3, serving as the inductive impendance, is covered by a casing 21 made of an insulating material to protect against electric shock hazard. Choke coil 3 is fixed around and to the neck of the glass bulb 13 as described in Hungarian patent application No. 287/81, corresponding to U.S. Patent Application Ser. No. 340,297 filed Jan. 18, 1982. Inside the protective casing 21 below the choke coil 3 are arranged the interrupter element 5 and the equivalence circuit 6 as well as the electronic control circuitry comprising the voltage divider system 11, which according to FIG. 1 advantageously consists of integrated circuits. A traditional lamp cap 22 is fixed to the bottom of the protective casing 21, which has the well-known terminals 23, 24 to which the mains terminals of the unit are connected. The "spatial" internal wiring shown in FIG. 3 corresponds to the wiring diagram according to FIG. 1.

The above description of the preferred embodiment is presented for illustrative purposes only and is not intended to limit the scope of the present invention as claimed in the appended claims. It will be understood that modifications and variations may be effected without departing from the scope of the inventive concept herein disclosed.

I claim:

1. A lighting system comprising:

(a) a high pressure gas-discharge light source;

(b) terminals for connecting said high-pressure gas-discharge lamp to an A.C. source;

(c) an incandescent or a standby filament;

(d) a current-limiting impedance element coupling said high pressure gas discharge light source to said A.C. source;

(e) a controllable interrupter element coupling said incandescent filament to said A.C. source;

(f) a voltage divider system comprising first and second voltage dividers; each divider for generating a predetermined voltage responsive to the level of energizing said gas-discharge lamp source;

(g) control means for controlling said controllable interrupter element, said control means comprising an output terminal connected to said interrupter element, and first and second input terminals connected to respective output terminals of said voltage dividers, wherein said output terminal is energized if both of said input terminals are similarly energized and said control means comprising first and second AND-gates, an OR-gate and two inverters connected between inputs of said first and second AND-gates, outputs of said first and second AND-gates connected to inputs of said OR-gate and input terminals of said control means are represented by inputs of said first AND-gate, while output terminal of said control means is represented by output of said OR-gate.

2. A lighting system as claimed in claim 1 wherein said output terminal is connected to an input of said interrupter element and said interrupter element is closed when said output terminal is energized.

3. A lighting system as claimed in claim 2, wherein said incandescent filament and said interrupter element are connected in series to form a first series connection, said gas discharge light source and said current-limiting impedance element are connected in series to form a second series connection, and said first and second series connections are connected in parallel across a first and second junctions.

4. A lighting system as claimed in claim 3, wherein said gas discharge light source and said voltage divider system are connected in parallel across a third and fourth junctions.

5. A lighting system as claimed in claim 4, wherein said first input terminal of said control means is connected to said first voltage divider and said second input terminal is connected to said second voltage divider.

6. A lighting system as claimed in claim 5, wherein one of said first and second voltage dividers comprises a first voltage-dependent element.

7. A lighting system as claimed in claim 6, wherein said voltage-dependent element is selected from the group consisting of a varistor or a glow lamp.

8. A lighting system as claimed in claim 5, wherein said interrupter element is selected from the group consisting of an electromagnetic switch, a thyristor, or a Triac.

9. A lighting system as claimed in claim 5, wherein said gas discharge light source is selected from the group consisting of a high-pressure sodium vapor lamp, a metal-halogen lamp, or a mercury vapor lamp.

10. A lighting system as claimed in claim 9, wherein said gas discharge light source is selected from the group consisting of a discharge vessel of a high-pressure sodium vapor lamp, of a metal-halogen lamp, or of a mercury vapor lamp.

11. A lighting system as claimed in claim 10, further comprising a light-transmitting glass envelope, wherein said glass envelope is hermetically sealed, and said discharge vessel and said encandescent light source are disposed within said glass envelope and are insulated from each other.

12. A lighting system as claimed in claim 11, further comprising first through fourth current lead-in support terminals leading out from said glass envelope, wherein said discharge vessel and said incandescent light source are electrically and mechanically connected to said first and second and to said third and fourth current lead-in support terminals, respectively, and said first through fourth current lead-in support terminals are further connected, respectively, to said third junction, to said fourth junction, to said first junction, and to said interrupter element.

13. A lighting system as claimed in claim 12, wherein said current-limiting impedance element has an annular cylindrical configuration, said glass envelope has a bulb-like configuration comprising a neck portion, and said current-limiting impedance unit partially surrounds and is rigidly fixed to said neck portion.

14. A lighting system as claimed in claim 1, further comprising a casing and a lamp cap, wherein said current-limiting impedance unit is rigidly fixed to said casing and said casing is rigidly fixed to said lamp cap.

15. A lighting system as claimed in claim 3, wherein said first and second junctions are connected to mains terminals.

* * * * *